US008814453B2

(12) United States Patent
Tsuchiya et al.

(10) Patent No.: US 8,814,453 B2
(45) Date of Patent: Aug. 26, 2014

(54) PRINTER

(75) Inventors: Masahiro Tsuchiya, Tokyo (JP); Yukihiro Mori, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 207 days.

(21) Appl. No.: 13/437,166

(22) Filed: Apr. 2, 2012

(65) Prior Publication Data

US 2012/0251215 A1 Oct. 4, 2012

(30) Foreign Application Priority Data

Apr. 4, 2011 (JP) ..... 2011-083050

(51) Int. Cl.

| | |
|---|---|
| ***B41J 11/22*** | (2006.01) |
| ***B41J 11/70*** | (2006.01) |
| ***B41J 15/04*** | (2006.01) |
| ***B26D 1/08*** | (2006.01) |
| *B26D 1/00* | (2006.01) |

(52) U.S. Cl.

CPC ..... *B41J 11/70* (2013.01); *B26D 2001/0066* (2013.01); *B41J 15/04* (2013.01); *B26D 1/085* (2013.01)

USPC ..... 400/649; 400/693; 347/222

(58) Field of Classification Search

USPC ..... 400/649

See application file for complete search history.

(56) References Cited

U.S. PATENT DOCUMENTS

| | | | | |
|---|---|---|---|---|
| 5,001,498 | A * | 3/1991 | Shimizu et al. | 347/215 |
| 6,022,158 | A * | 2/2000 | Nakayama et al. | 400/613 |
| 6,345,782 | B1 * | 2/2002 | Nakayama et al. | 242/564.4 |
| 6,567,113 | B2 * | 5/2003 | Louis | 347/222 |
| 7,207,737 | B2 * | 4/2007 | Bhatia et al. | 400/693 |
| 7,828,490 | B2 * | 11/2010 | Nihashi et al. | 400/693 |
| 7,929,005 | B2 * | 4/2011 | Hirai et al. | 347/198 |
| 8,094,175 | B2 * | 1/2012 | Yokoyama | 347/220 |
| 2010/0053297 | A1 | 3/2010 | Yokoyama | |

FOREIGN PATENT DOCUMENTS

| | | |
|---|---|---|
| JP | 2010-052278 | 3/2010 |

* cited by examiner

*Primary Examiner* — Jill Culler

(74) *Attorney, Agent, or Firm* — IPUSA, PLLC

(57) ABSTRACT

A printer including: a fixed part; a movable part that is connected to the fixed part rotatably around a rotation center such that one of an open state and a closed state is selectable; a cylindrical body configured to transfer a print medium; a holding part configured to hold the cylindrical body; and a restraint part configured to restrain the holding part to the movable part such that the movable part can slide in a radial direction of the rotation center; wherein the restraint part includes: an engaging part that forms a part of one of the holding part and the movable part; and an engaged part that forms a part of another one that is engaged to the engaging part, and the fixed part includes a storing part configured to store spindles of the transfer cylindrical body.

17 Claims, 15 Drawing Sheets

PRINTER

CROSS-REFERENCE TO RELATED APPLICATION

The present application is based upon and claims the benefit of priority of Japanese Patent Application No. 2011-083050, filed on Apr. 4, 2011, the entire contents of which are incorporated herein by reference.

BACKGROUND OF THE INVENTION

1. Field of the Invention

An embodiment relates to a printer for performing a series of operation related to printing that includes transferring a band-like medium on which printing is performed (to be referred to as print medium hereinafter), performing printing on the print medium, and cutting the print medium after performing printing.

2. Description of the Related Art

As a printer that performs transferring a print medium, printing on the print medium and cutting the print medium after printing, there is a printer disclosed in Japanese Laid-Open Patent Application No. 2010-52278 (to be referred to as patent document 1), for example. In the printer like the one disclosed in the patent document 1, when the print medium is a receipt, for example, the printer prints, an the print medium, various pieces of information such as a name of product, product price, handled date and time, and obtained points. In the case when the print medium is a magnetic medium such as a train ticket or a performance ticket, the printer prints various pieces of information such as a ride section, date and time, fee, or performance contents, date and time, fee of the performance, and the like.

The printer includes a movable part and a fixed part. But, there is a problem in that engagement between the movable part and the fixed part is unstable.

SUMMARY OF THE INVENTION

An object of an embodiment is to provide a printer for realizing secure and smooth engagement between a movable part and a fixed part.

According to an embodiment, there is provided a printer including:

a fixed part;

a movable part that is connected to the fixed part rotatably around a rotation center such that one of an open state and a closed state is selectable;

a cylindrical body configured to transfer a print medium;

a holding part configured to hold the cylindrical body; and a restraint part configured to restrain the holding part to the movable part such that the movable part can slide in a radial direction of the rotation center;

wherein the restraint part includes:

an engaging part that forms a part of one of the holding part and the movable part; and an engaged part that forms a part of another one of the holding part and the movable part and that is engaged to the engaging part, and the fixed part includes a storing part configured to store spindles placed in both ends of the transfer cylindrical body when the movable part is in the closed state.

DETAILED DESCRIPTION OF THE PREFERRED EMBODIMENTS

Figure 1:
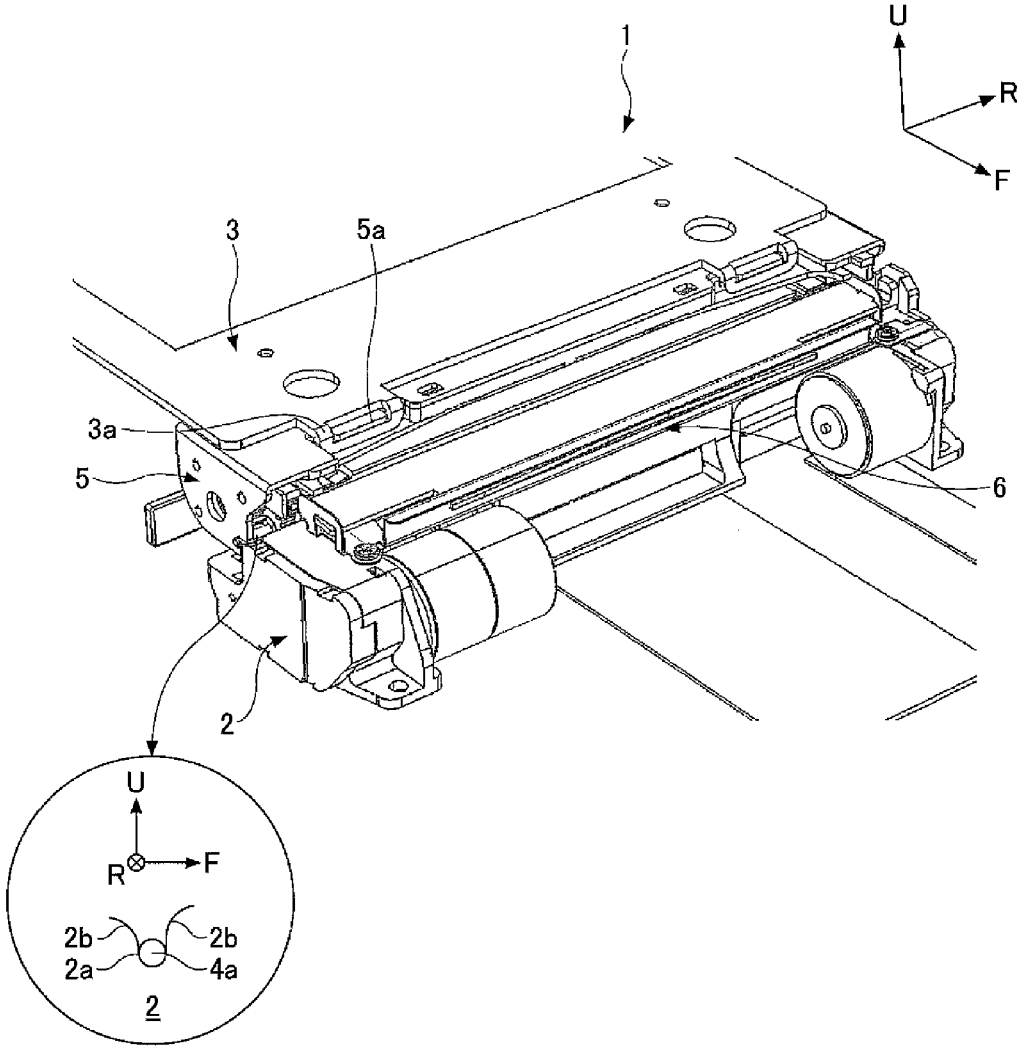
FIG. 1 is a schematic perspective view of an embodiment 1 of a printer 1.

Prior to describing embodiments, a problem of the related art will be described in more detail for convenience of understanding.

In the related art, there is a printer that includes a platen roller, print head, a cutting part including a movable blade and a fixed blade, a body frame that is a fixed part, and a open-close cover that is a movable part. The movable part is connected to the fixed part using a hinge. In the printer, the platen roller and one of the movable blade and the fixed blade are placed in the open-close cover. Also, the print head and another one of the cutting parts are placed in the body frame. Also, a pair of engaging parts and a lock arm are provided in the body frame, in which the engaging parts are placed at positions corresponding to a spindle of the platen roller.

In the above-mentioned printer, the platen roller is provided swingably with respect to the open-close cover via a swing shaft that is placed perpendicularly to the spindle and at the center in the horizontal direction.

In addition, in the above-mentioned printer, the engaging part for engaging the spindle does not have a structure for absorbing an error in a radial direction that is perpendicular to a rotation axis. In order to perform storing that is performed before engaging, a near part of the swing shaft includes a sliding function for allowing for error in the direction of the swing shaft. The error includes a design error, fabrication error and the like.

However, the configuration in the vicinity of the swing shaft includes a bracket, connecting pins and the like, in order to absorb the before-mentioned error. Thus, the configuration may cause complication of the mechanism, increase of thickness of the open-close cover, and increase of the number of parts. Therefore, there are disadvantages in that cost may increase, and flexibility of configuration inside the printer may deteriorate.

As a simple structure in order to eliminate such disadvantages, a printer is proposed in which an oval-like part is provided. The oval-like part has its major axis in a direction for absorbing the error at a rotation axis of the open-close cover with respect to the body frame.

However, in the case where the open-close cover is provided with the oval-like part for absorbing the error near the rotation axis, behavior of the open-close cover with respect to the body frame becomes unstable. More specifically, behavior of the open-close cover with respect to the body frame becomes unstable in a direction other than the rotation direction centered on the rotation axis in a time other than when the open-close cover is closed. Thus, there is a problem in that customer satisfaction is lowered.

Following embodiments are provided for realizing sure and smooth engagement between a movable part and a fixed part so as to enhance customer satisfaction.

In the following, embodiments are described with reference to FIGS. 1-16. In FIGS. 1-16 used for explanation of embodiments, "F" indicates a front direction in a front-back direction, "U" indicates an upper direction in a vertical direction and "R" indicates a right direction in a horizontal direction.

Embodiment 1

Figure 2:
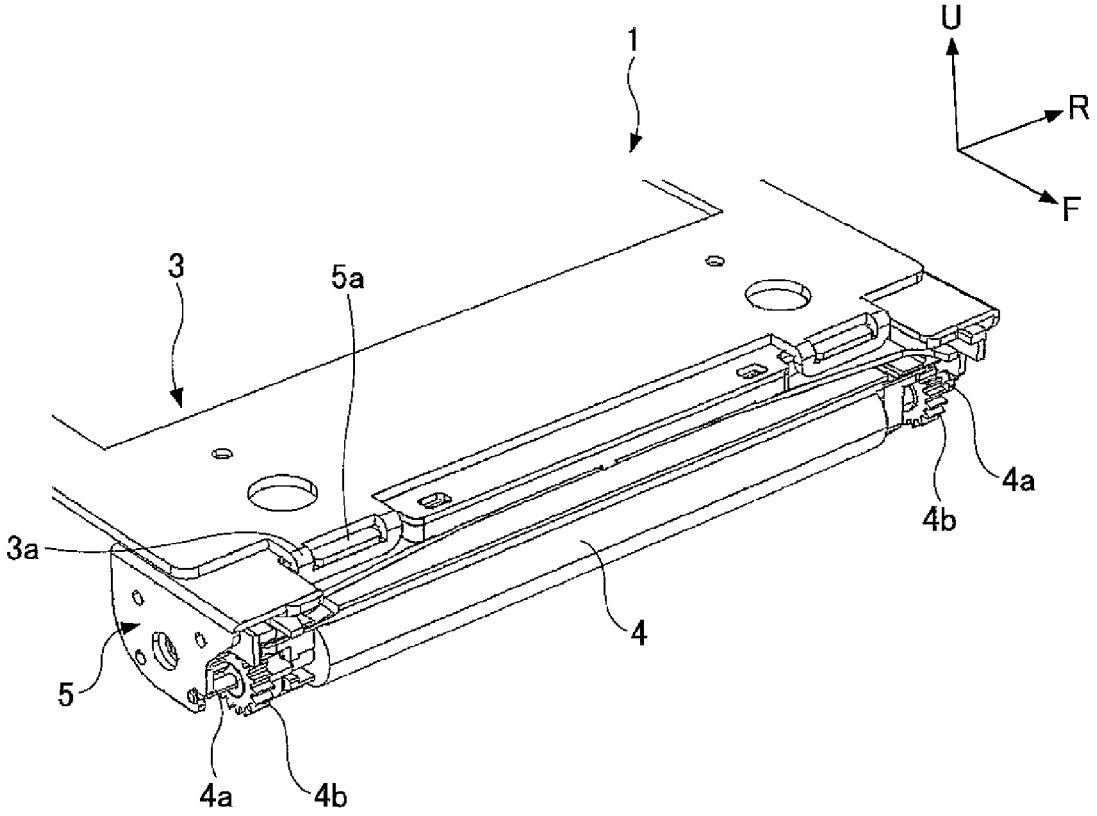
FIG. 2 is a schematic perspective view of a connection example between the open case 3 and the platen unit case 5 of the printer 1 of the embodiment 1.

As shown in FIGS. 1 and 2, a printer 1 of the present embodiment includes a body-side case 2 (fixed part), an open case 3 (movable part), a platen roller 4 (transfer cylindrical body), a platen case unit 5 (holding part) and a head unit 6. As shown in FIG. 2, the platen roller 4 is placed in front of and on the lower side of the platen unit case 5. As shown in FIG. 1, the head unit 6 is placed in the side of the body-side case 2.

The open case 3 is held via a rotation part and a lower case (which are not shown in FIG. 1), in which the rotation part includes a rotation center that is placed in a left-rear side of FIG. 1, and the lower case includes the rotation part. The open case 3 is connected to the body-side case 2 so as to be rotatable around the rotation center. An open state and a closed state can be selected for the open case 3. The open state is a state in which the open case 3 is rotationally moved to the upper side, and the closed state is a state in which the open case 3 is rotationally moved downward so that the open case 3 is fixed and engaged to the body-side case 2.

Figure 3A:
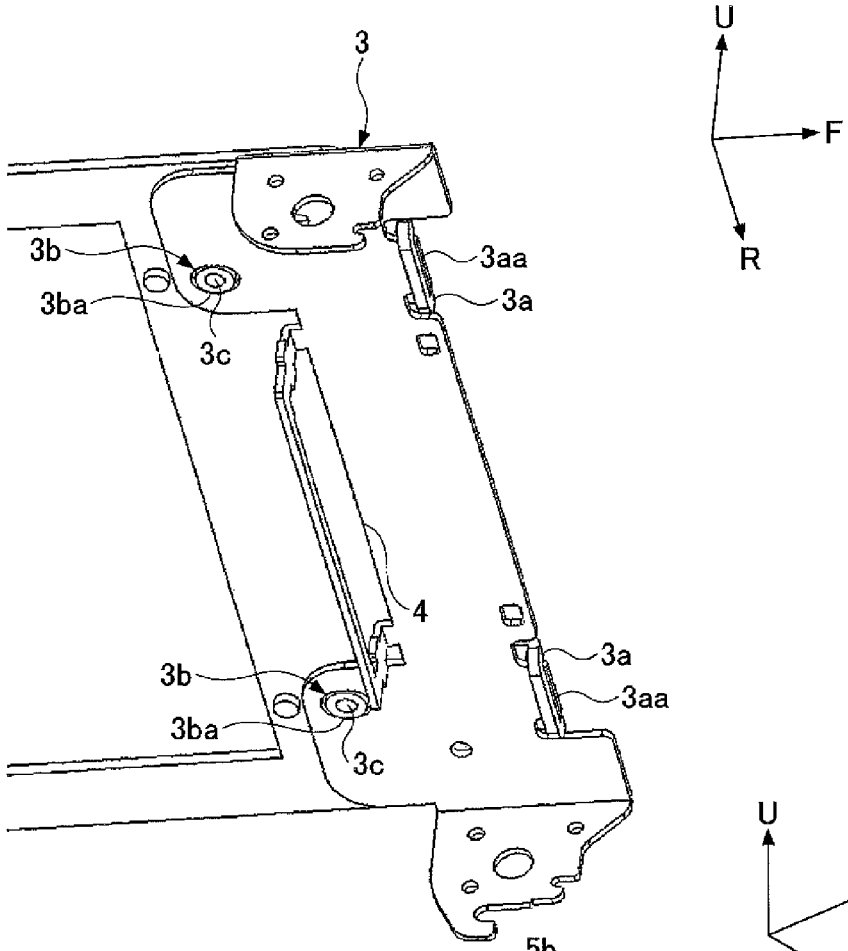
FIGS. 3A and 3B are schematic perspective views of a part contributing to the connection between the open case 3 and the platen unit case 5 of the printer 1 of the embodiment 1.

The body-side case 2 is formed by properly bending a metal plate such as a zinc die-cast metal plate and performing press working such as cutout, for example. As shown in FIG. 3A, the open case 3 is formed like a plane plate having a part perpendicular to the vertical direction by bending a metal plate such as a stainless alloy and the like, for example.

Figure 3B:
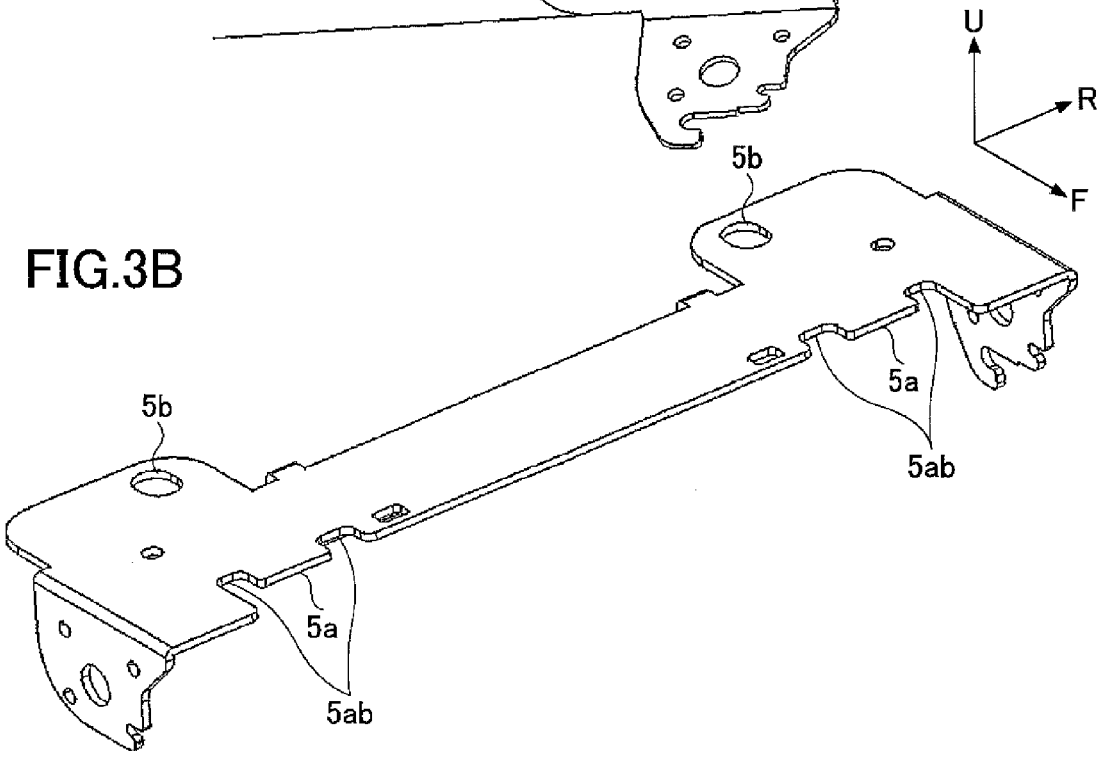

As shown in FIG. 3B, the platen unit case 5 includes a plane part and a pair of left-right leg parts, in which the plane part extends in the horizontal direction and is perpendicular to the vertical direction, and the leg parts are perpendicular to the horizontal direction. The platen unit case 5 is formed by molding a resin plate such as polycarbonate and the like, for example. A left-right pair of projected pieces 5*a* are formed in an integral manner near a left end and a right end of the front end of the plane part. In each of the projected pieces 5*a*, concave parts 5*ab* are formed in both of left-right sides of the projected piece 5*a*, in which the concave parts 5*ab* correspond to parts placed at both sides of a hole part 3*aa* of a folded part 3*a* of the open case 3.

The platen roller 4 shown in FIG. 2 includes a function for transferring a print medium such a receipt, a ticket and the like (not shown in the figure) from a winding body to a printing part, in which the print medium is wound around the winding body. The platen roller 4 is rotatably held to the platen unit case 5. A carrying gear 4*b* for transferring is driven and connected to a platen motor in the side of the body-side case 2 via a driving gear for transferring in the closed state.

The printer 1 of the present embodiment includes a driving mechanism of the movable blade and a movable blade holding part, in which the driving mechanism includes a driving gear for cutting and a transferring gear for cutting. The driving gear for cutting (not shown in the figure) is placed in the body-side case 2, in which the driving gear for cutting drives the movable blade placed in the side of the platen unit case 5 via the transferring gear for cutting.

In the closed state, the driving gear for cutting placed in the body-side case 2 is engaged with the transferring gear for cutting placed in the platen unit case 5. A motor for cutting that drives the driving gear for cutting is placed in a side of the driving gear for cutting. The platen unit case 5 includes a movable blade holding part (not shown in the figure) for moving back and forth the movable blade based on a driving force transmitted from the driving gear for cutting to the transferring gear for cutting.

That is, as an inside structure of the printer 1 of the present embodiment, the printer 1 includes the motor for cutting, the driving gear for cutting, the motor for transferring and the driving gear for transferring in the side of the body-side case 2. Also, the transferring gear for cutting, the movable blade holding part and the carrying gear 4*b* for transferring are placed in the side of the platen unit case 5. Accordingly, a so-called clamshell type is adopted.

In the open state, the platen unit case 5 is flipped up in a direction separating from the body-side case 2 by rotational move of the open case 3, so that driving-connection between the driving gear and the carrying gear for transferring is released, and driving-connection between the driving gear and the carrying gear for cutting is released.

In the closed state, an upper surface of the fixed blade (not shown in the figure) contacts a lower surface of the movable blade, and the fixed blade is placed in the side of the body-side case 2 such that it is pressed by a spring (not shown in the figure). The platen roller 4 is placed in a rear side of the fixed blade, and the head unit 6 is placed in a front side of the platen roller 4. The print medium passes through a path between the head unit 6 and the platen roller 4 and between the movable blade and the fixed blade and a path to an exit.

The head unit 6 includes a function configured to perform printing on the print medium in the closed state, and the head unit 6 forms a printing part. The platen unit case 5 and the open case 3 include a restraint unit 5*a*+3*aa* configured to restrain the platen unit case 5 such that the platen unit case 5 can flexibly slide in a radial direction of the rotation center with respect to the open case 3.

The restraint unit 5*a*+3*aa* includes the projected piece 5*a* (engaging part) that is a part of one of the platen unit case 5 and the open case 3 (the platen unit case 5 in this embodiment), and the hole part 3*aa* (engaged part) formed in the folded part 3*a* that is a part of the open case 3 which is another one of the platen unit case 5 and the open case 3. The hole part 3*aa* is provided as a form directed toward the radial direction of the rotation center at a part directed toward a front direction of the folded part 3*a*, and the projected piece 5*a* is inserted into the hole part 3*aa* in the radial direction.

In addition to that, the body-side case 2 of the printer 1 of the present embodiment 1 includes a left-right pair of storing parts 2*a* each having a concave groove shape as shown in a balloon of the lower left side of FIG. 1. The storing parts 2*a* store spindles 4*a* at both sides in the extending direction of the rotation center of the platen roller 4 when the open case 3 is in the closed state. The figure in the balloon of FIG. 1 shows a vertical section of parts including the spindle 4*a* and the storing part 2*a* with respect to the axis direction of the platen roller 4.

Also, the body-side case 2 of the printer 1 of the present embodiment 1 includes a guide part configured to guide the left-right pair of spindles 4*a* of the platen roller 4 into the storing part 2*a* before the open case 3 is changed to the closed state.

The guide part includes an inclined surface 2*b* that forms a curved surface such that the inclining angle gradually increases from a lower side toward an upper side with respect to an arc-like moving locus of the spindle 4*a* centered on the rotation center of the spindle 4*a* when the open case 3 is changed from the open state to the close stage. As shown in the balloon of FIG. 1, the inclined surfaces 2*b* are formed in both sides of each of the pair of storing parts 2*a* in a front-back direction, such that the inclined surfaces 2*b* form like a shape spreading out wide toward the end from the lower side to the upper side. Since the rotation center is positioned at the rear side, the inclined surface 2*b* of the front side is displaced to the upper side compared to the inclined surface 2*b* in the rear side.

The printer 1 of the present embodiment 1 includes a lock arm and an open lever (which are not shown in the figure). The lock arm locks the spindle 4*a* when the spindle 4*a* is stored in the storing part 2*a* so that the open case 3 is closed. The open lever releases lock of the lock arm when the state changes from the closed state to the open state.

Figures 4A, 4B:
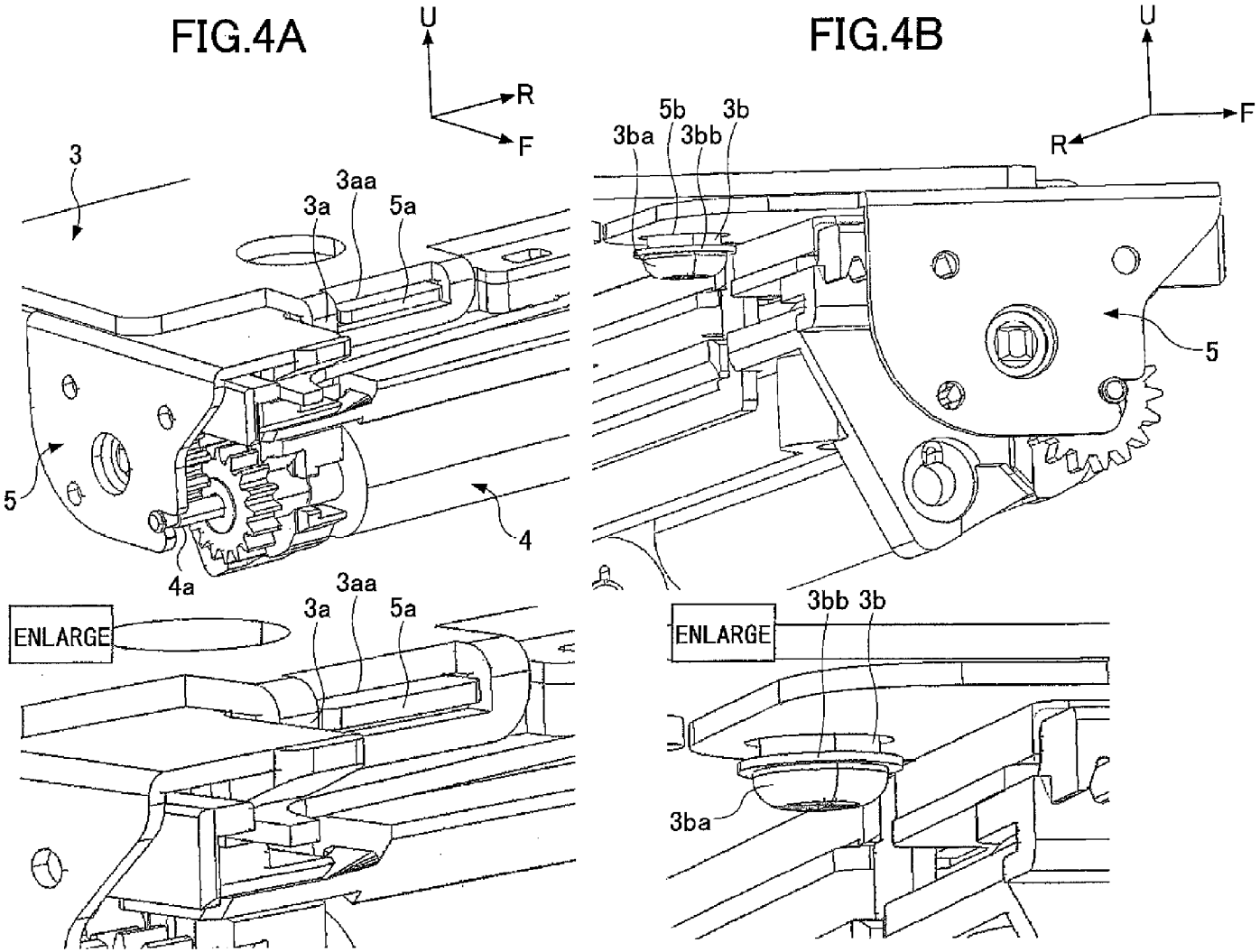
FIGS. 4A and 4B are enlarged schematic perspective views of parts contributing to the connection between the open case 3 and the platen unit case 5 of the printer 1 of the embodiment 1.
Figure 5B:
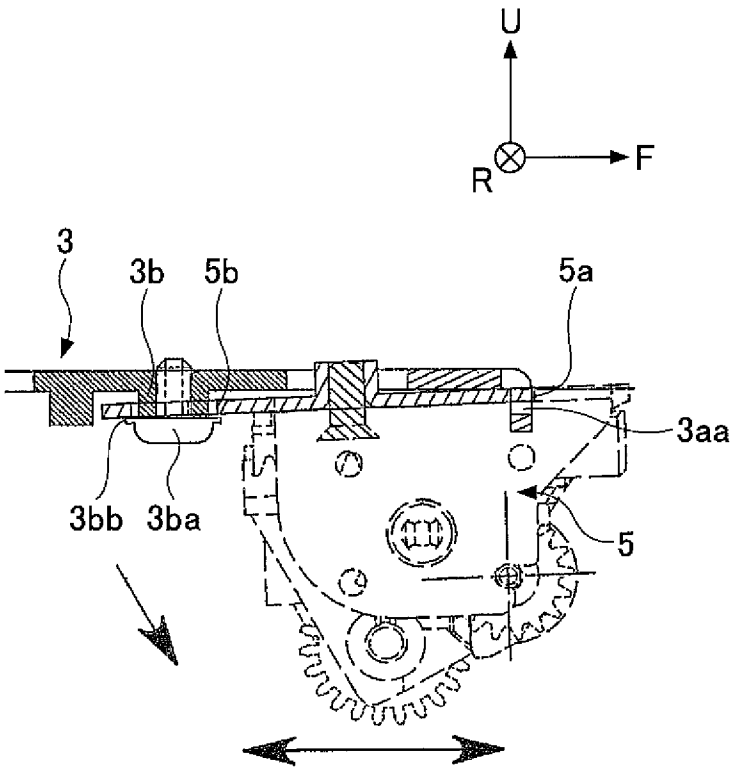
FIGS. 5A and 5B are schematic perspective views of a case where the platen unit case 5 is fluctuated around a horizontal direction with respect to the open case 3 in the printer 1 of the embodiment 1.
Figure 5A:
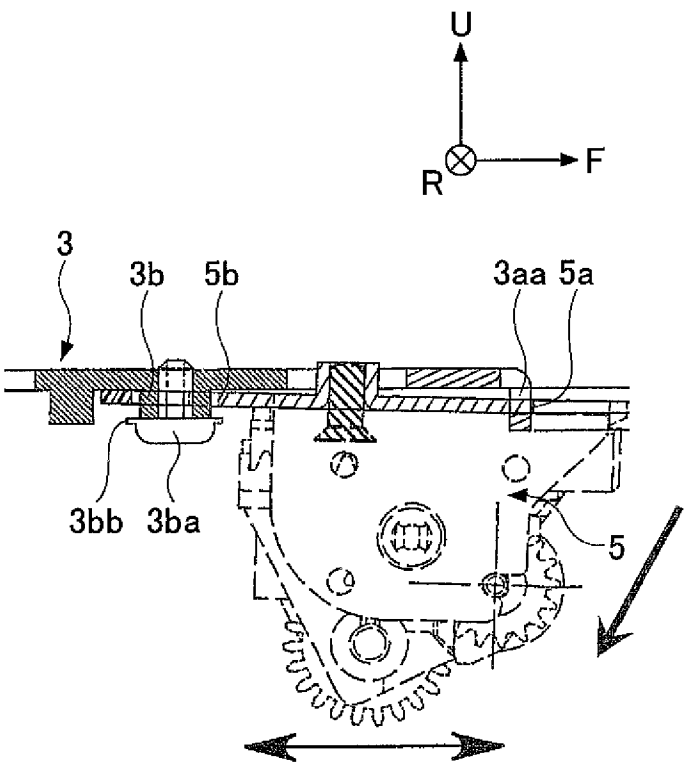

In the present embodiment 1, the projected piece 5*a* is engaged to the hole part 3*aa*, while an allowance is included in the vertical direction as shown in FIG. 4A and FIGS. 5A and 5B. That is, the size of the hole part 3*aa* in the vertical direction is set to be larger than the thickness of the projected piece 5*a*.

In addition, in the present embodiment 1, as shown in FIGS. 3A and 3B, a control part 3*b*+5*b* is included for controlling an amount of sliding of the holding part in the radial direction with respect to the open case 3. As shown in FIG. 4B and FIGS. 5A and 5B, the control part 3*b*+5*b* includes a boss 3*b* (projected part) that protrudes from one of the platen unit case 5 and the open case 3 to another one of them (protrudes downward from the open case 3 in this embodiment) and a hole part 5*b* included in the platen unit case 5 that is another one of the platen unit case 5 and the open case 3.

Further, as shown in FIG. 4B and FIGS. 5A and 53, the boss 3*b* includes a top part 3*ba* in the side where the boss 3*b* projects downward from a part inserted in the hole part 5*b*, in which the top part 3*ba* has an outer size larger than the size of the hole part 5*b*. The vertical length of the boss 3*b* between the base part and the top part 3*ba* is greater than the depth size of the hole part 5*b*, that is, the thickness of a plate forming the platen unit case 5.

The boss 3*b* is formed, first, by projecting a part of the open case 3 downward to form a shape like a cylinder by burring or doweling. After that, in an assembly stage, the cylindrical part is inserted into the hole part 5*b*, and an embedding part 3*c* shown in FIG. 3A is piled and embedded from the downside in the lower end part of the cylindrical part. As a result, the boss 3*b* is formed such that it includes the top part 3*ba* and a plane edge part 3*bb* having a radius larger than that of the top part 3*ba*.

Figure 6:
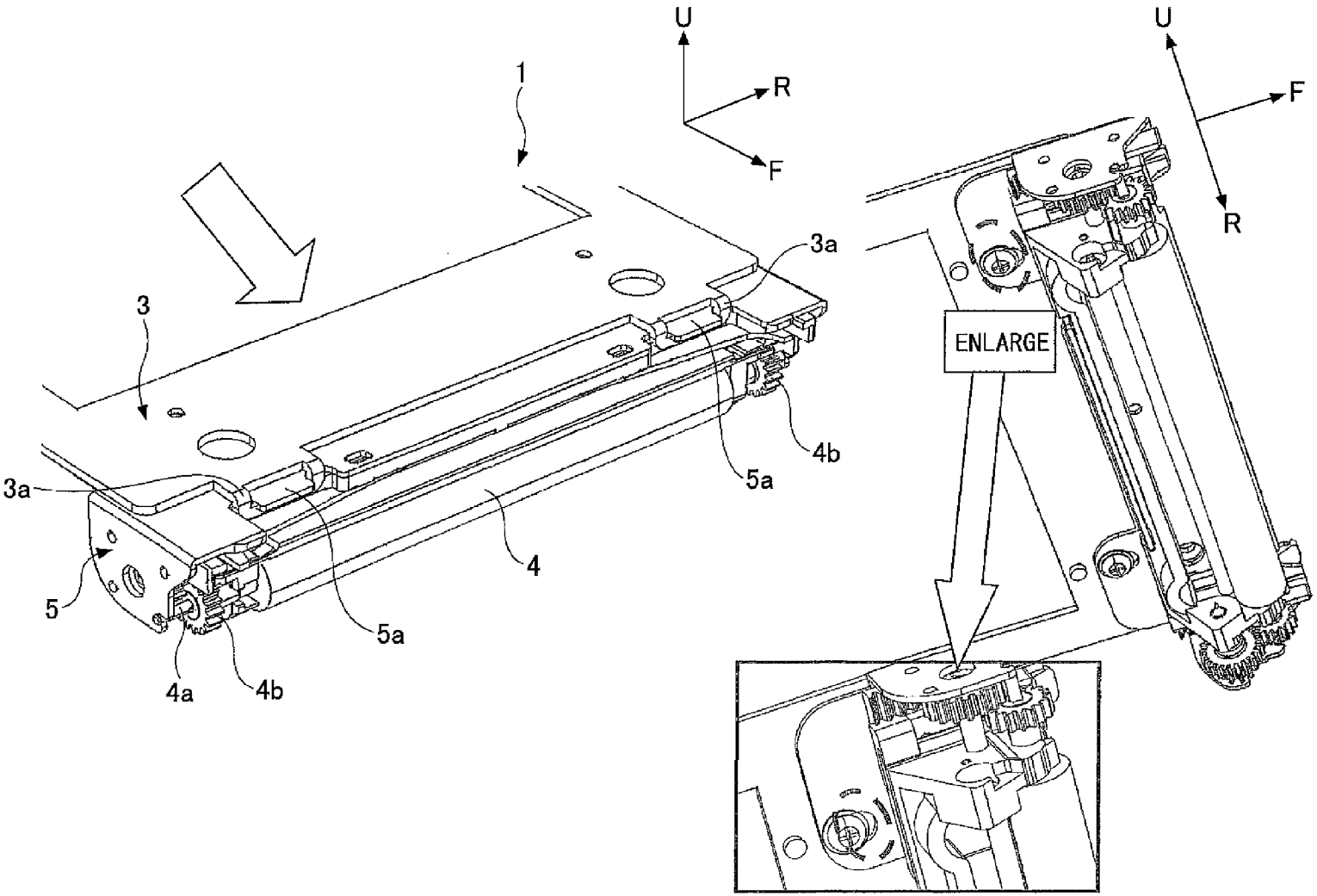
FIG. 6 is a schematic perspective view of a case where the platen unit case 5 is slid forward with respect to the open case 3 in the printer 1 of the embodiment 1.

In the printer 1 of the present embodiment 1, as shown in FIG. 6, when the open case 3 moves to an outside of the radial direction of the rotation center with respect to the platen unit case 5, that is, when the open case 3 moves relatively frontward with respect to the platen unit case 5, an amount of projection of the projected piece 5*a* to the front side from the hole part 3*aa* becomes large, so that sliding of the open case 3 toward the outside in the radial direction, that is, toward the front side with respect to the platen unit case 5 is allowed until the back end of the inside wall of the hole part 5*b* contacts the boss 3*b* as shown in FIG. 6.

Figure 7:
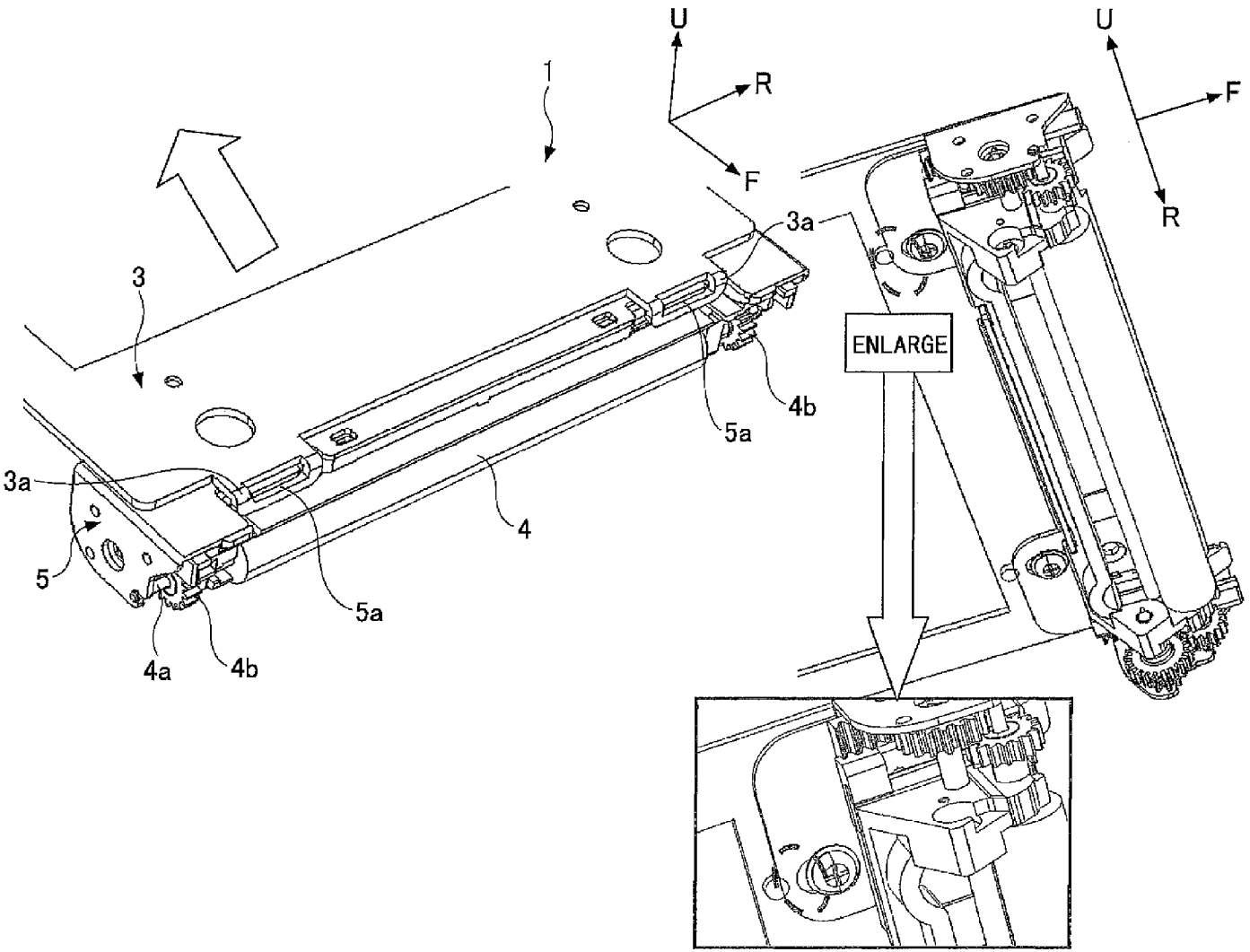
FIG. 7 is a schematic perspective view of a case where the platen unit case 5 is slid backward with respect to the open case 3 in the printer 1 of the embodiment 1.

Also, in the present embodiment 1, as shown in FIG. 7, when the open case 3 moves to an inside of the radial direction of the rotation center with respect to the platen unit case 5, that is, when the open case 3 moves relatively backward with respect to the platen unit case 5, an amount of projection of the projected piece 5*a* to the front side from the hole part 3*aa* becomes small, so that sliding of the open case 3 toward the inside in the radial direction, that is, toward the back side with respect to the platen unit case 5 is allowed until the front end of the inside wall of the hole part 5*b* contacts the boss 3*b* as shown in FIG. 7.

That is, in the present embodiment 1, based on both of the slide allowing function of the restraint part 5*a*+3*aa* and the slide amount control function of the control part 3*b*+5*b*, and based on the guiding function of the inclined surface 2*b*, relative movement between the platen case 3 and the platen unit case 5 in the radial direction, that is, in the front-back direction, is properly allowed. Thus, even when an error occurs in a relative position of the spindle 4*a* of the platen roller 4 with respect to the storing part 2*a* in the side of the body-side case 2, the error is allowed and absorbed. Therefore, when the state changes to the closed state, the spindle 4*a* is stored in the storing part 2*a* surely and smoothly, so that operability and operation feeling by a user are enhanced so that customer satisfaction can be improved.

In addition, in the present embodiment 1, as mentioned before, both of the restraint part 5*a*+3*aa* and the control part 3*b*+5*b* include a structure having an allowance in the vertical direction. Thus, as shown in FIGS. 5A and 5B, even when the platen unit case 5 rotates around a horizontal axis with respect to the open case 3, the rotation can be allowed within a predetermined limit.

More specifically, as shown in FIG. 5A, when the platen unit case 5 rotates in a clockwise direction, the rotation is allowed until the projected piece 5*a* of the platen case unit 5 contacts the lower end surface of the hole part 3*aa* and the back end of the platen unit case 5 contacts the lower surface of the open case 3.

In the same way, as shown in FIG. 5B, when the platen unit case 5 rotates in a counterclockwise direction, the rotation is allowed until the projected piece 5*a* contacts the upper end surface of the hole part 3*aa* and the back end of the platen unit case 5 contacts the plane edge part 3*bb* of the top part 3*ba* of the open case 3.

Also, in the printer 1 of the present embodiment 1, when an error occurs in a relative position of the spindle 4*a* with respect to the storing part 2*a* in the radial direction of the rotation center, the restraint part 5*a*+3*aa* absorbs the error based on the slide allowing function in the radial direction included in the restrain part 5*a*+3*aa*, wherein the restrain part 5*a*+3*aa* includes the projected piece 5*a* and the hole part 3*aa*. That is, it is unnecessary to provide an oval-like part in a rotation part placed between a lower case and an open case like a conventional technique.

Therefore, it becomes possible to eliminate the configuration for including a function of absorbing the error in the rotation part, as the rotation part is not necessarily appropriate for absorbing such error. In the conventional technique in which the rotation part includes the oval-like part, when the open case is changed to the open state from the closed state in which restraint of the spindle 4*a* of the platen roller 4 by the lock arm and the storing part 2*a* is released, holding force in the longer diameter direction of the oval-like part decreases.

In the conventional technique, in the case when a gravity is applied in the direction of the longer diameter of the oval-like part, the open case 3 may slide unintentionally so as to cause a feeling of wrongness to a user. On the other hand, according to the printer 1 of the present embodiment 1, it can be avoided that a user has such a feeling of wrongness, so that customer satisfaction can be increased.

In addition, according to the printer 1 of the present embodiment 1, the restraint part 5*a*+3*aa* is formed by a part of one of the platen unit case 5 and the open case 3, and a part of another one of the platen unit case 5 and the open case 3 that are originally included in the printer 1. Thus, it is unnecessary to add a new part for allowing the slide.

Also, according to the printer 1 of the present embodiment 1, the control part 3*b*+5*b* is formed by a part of one of the platen unit case 5 and the open case 3 and a part of another one of the platen unit case 5 and the open case 3 that are included in the printer 1. Thus, it is unnecessary to add a new part for controlling the slide amount.

Also, according to the printer 1 of the present embodiment 1, it is possible to surly store the spindle 4*a* of the platen roller 4 in the storing part 2*a* and to perform move from the open state to the closed state smoothly. Thus, in the closed state, it is possible to perform, stably and satisfactory, a series of operation including transfer of print medium, printing on the print medium, and cutting of the print medium by the cutting part that includes the movable blade and the fixed blade.

Figure 8B:
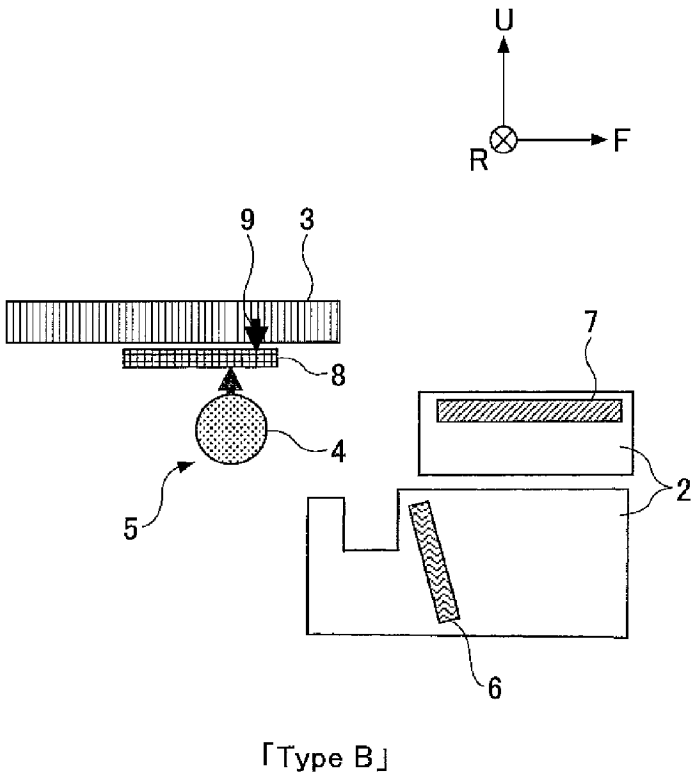
FIGS. 8A and 8B are schematic diagrams showing variations of placement of the movable blade 7, the fixed blade 8, the spring 7 for pushing one to the other, and the head unit 6 in the printer of the embodiment 1.
Figure 8A:
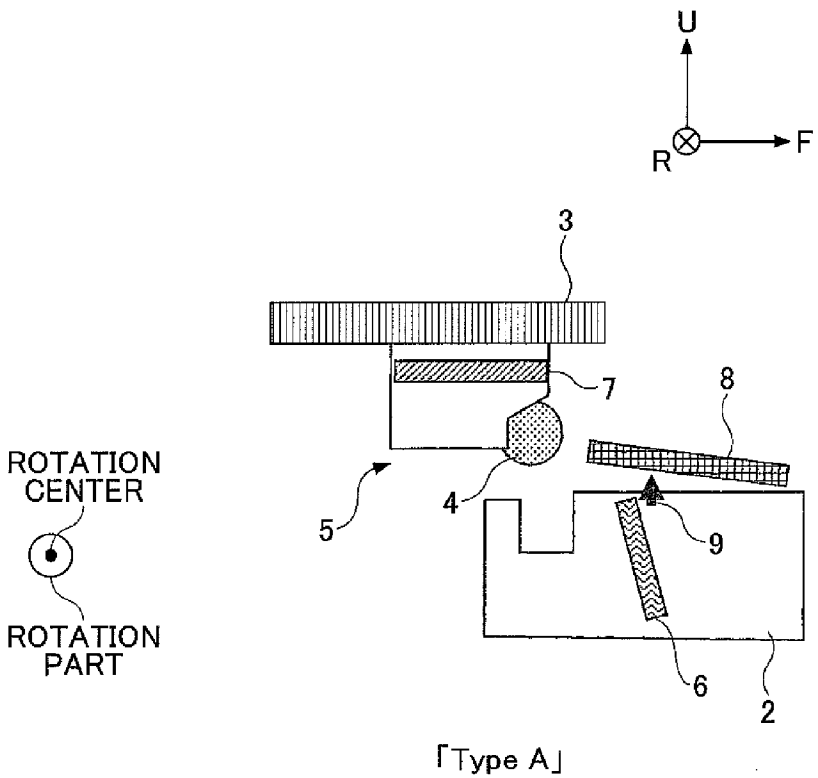

As shown in FIG. 8A, in the printer 1 of the embodiment 1, the platen unit case 5 that rotates around the rotation center with the open case 3 that is a movable part includes the movable blade 7 and the platen roller 4, and the body-side case 2 includes the head unit 6, the fixed blade 8 and the spring 9. Such a combination is called Type A for the sake of convenience. Also, FIG. 8A shows the rotation part and the rotation center as an example.

This combination of parts can be properly changed as shown in FIG. 8B. That is, the fixed blade 8 and the spring 9 may be included in the platen unit case 5, and the movable blade 7 and the head unit 6 may be included in the body-side case 2, which combination is called Type B.

In the embodiment 1, the restraint part 5*a*+3*aa* is placed in the front side, and the control part 3*b*+5*b* is placed in the back side. But, it is possible that the restraint part 5*a*+3*aa* may be placed in the back side, and the control part 3*b*+5*b* may placed in the front side.

Also, it is not essential that the folded part 3*a* includes the hole part 3*aa* and the hole part 3*aa* forms the engaged part. For example, it is possible to form the folded part 3*a* itself as an engaged part by providing two right-angled folded portions instead of one in the folded part 3*a* so as to form a U shape. As a result, a part of a lower side surface of the U-shaped part is formed, that is, a part extending from the front side toward the back side is formed, so that the folded part 3*a* holds the projected piece 5*a* from the lower side.

In the printer 1 of the embodiment 1, the operation feeling of the user is improved when the state changes from the open state to the closed state and from the closed state to the open state. In addition to that, behavior of the platen unit case 5 in the closed state can be also improved. In the following, an embodiment 2 related to the improvement of the behavior is described.

Embodiment 2

Figure 9:
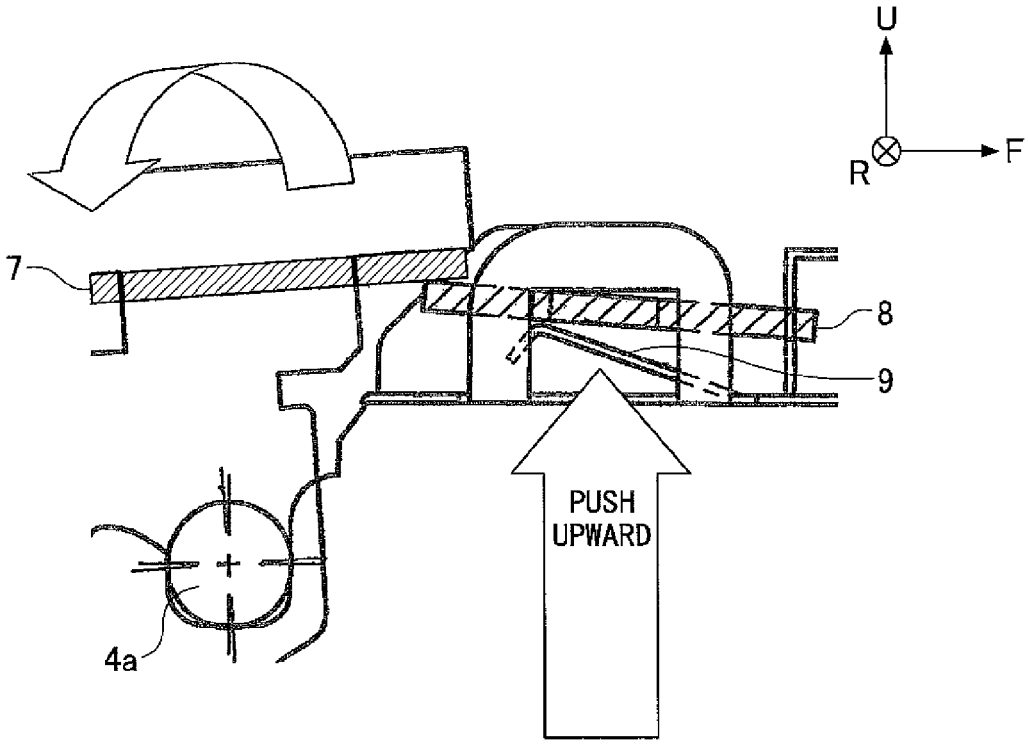
FIG. 9 is a schematic diagram showing a case in which the platen unit case 5 rotates around the horizontal direction when the open case 3 is in the closed state in the printer of the embodiment 1.
Figures 10A, 10B, 10C:
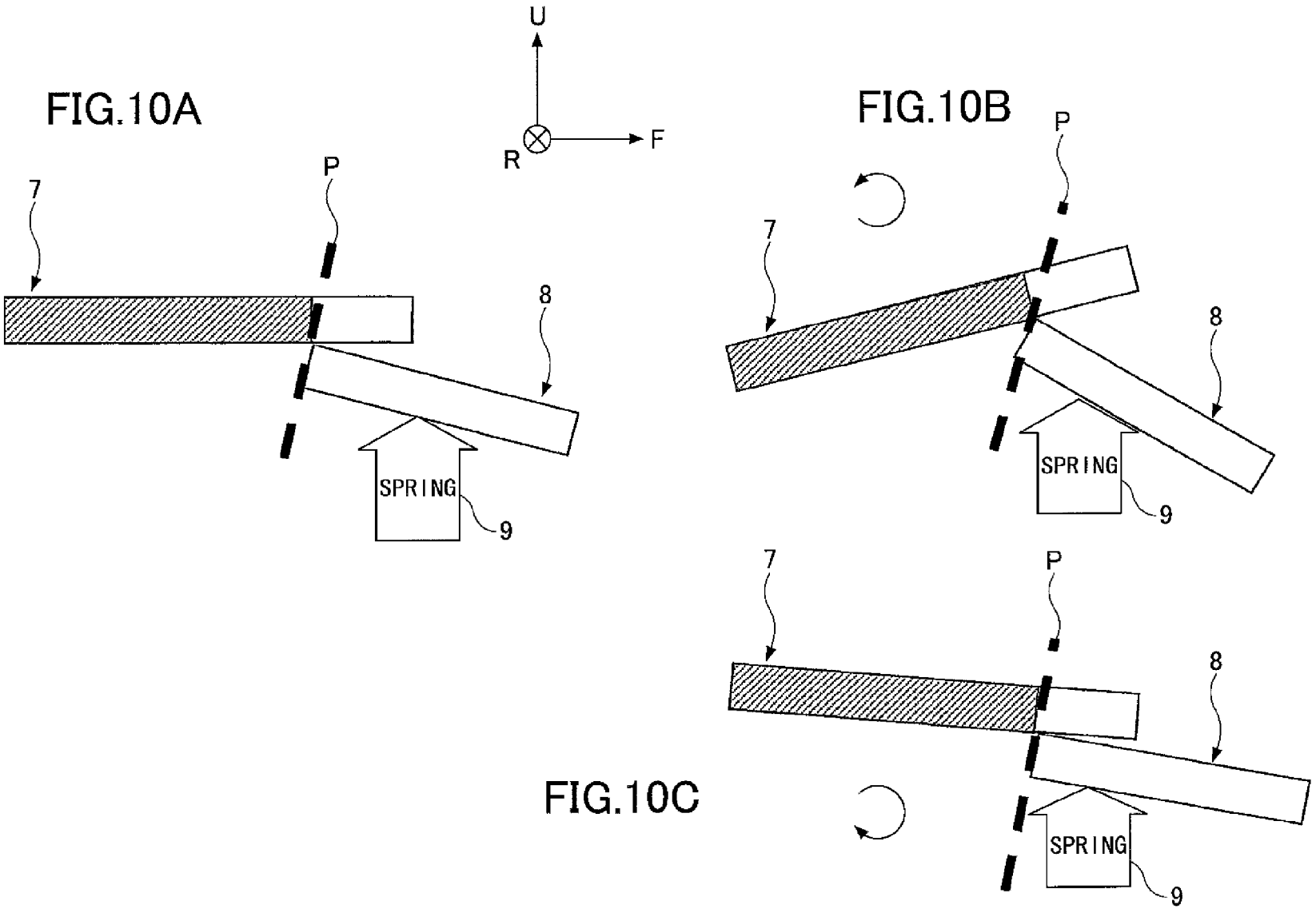
FIGS. 10A-10C are schematic diagrams showing a case in which the platen unit case 5 rotates around the spindle 4*a* when the open case 3 is in the closed state in the printer of the embodiment 1.

In the following, technical concept included in the printer 1 of the embodiment 2 is described with reference to FIGS. 9 and 10A-10C. As shown in FIG. 9, the fixed blade 8 is pushed upward by a spring 9 with respect to the movable blade 7 that forms a cutting part, so that a surface of the fixed blade 8 opposite to the movable blade 7 contacts the movable blade 7. As shown in FIG. 10A, when relative position relationship between the movable blade 7 and the fixed blade 8 is properly maintained according to the press force of the spring 9, cutting ability for cutting the print medium increases. The state shown in FIG. 10A is called a mode 1.

However, in the case when upward displacement of the upper end of the spring 9 is too large due to external interference such as vibration and application of external forces and the like, the mode is changed to a mode 2 shown in FIG. 10B. In the mode 2, the movable blade 7 rotates in a counterclockwise direction and the platen unit case 5 including the movable blade 7 rotates in a counterclockwise direction. The fixed blade 8 rotates in a clockwise direction.

In mode 2, when the upward displacement of the upper end of the spring 9 is too large, deflection amount for causing pressing force of the spring 9 becomes small, so that blade pressure of the fixed blade 8 becomes weak and the cutting ability for cutting the print medium is deteriorated. Also, when performing cutting operation, the blade edge of the movable blade 7 and the blade edge of the fixed blade 8 may contact with each other, which also causes deterioration of the cutting ability for cutting the print medium.

On the other hand, in the case when upward displacement of the upper end of the spring 9 is too small due to external interference such as vibration and application of external forces and the like, the mode is changed to a mode 3 shown in FIG. 10C. In the mode 3, the movable blade 7 rotates in a clockwise direction and the platen unit case 5 including the movable blade 7 rotates in a clockwise direction. The fixed blade 8 rotates in a counter clockwise direction.

In mode 3, when the upward displacement of the upper end of the spring 9 is too small, the deflection amount for causing pressing force of the spring 9 becomes large, so that blade pressure of the fixed blade 8 becomes large. But, the blade edge of the movable blade 7 is oriented downward. Thus, the print medium is vulnerable to tilt when cutting, which also causes deterioration of the cutting ability for cutting the print medium.

Figure 11:
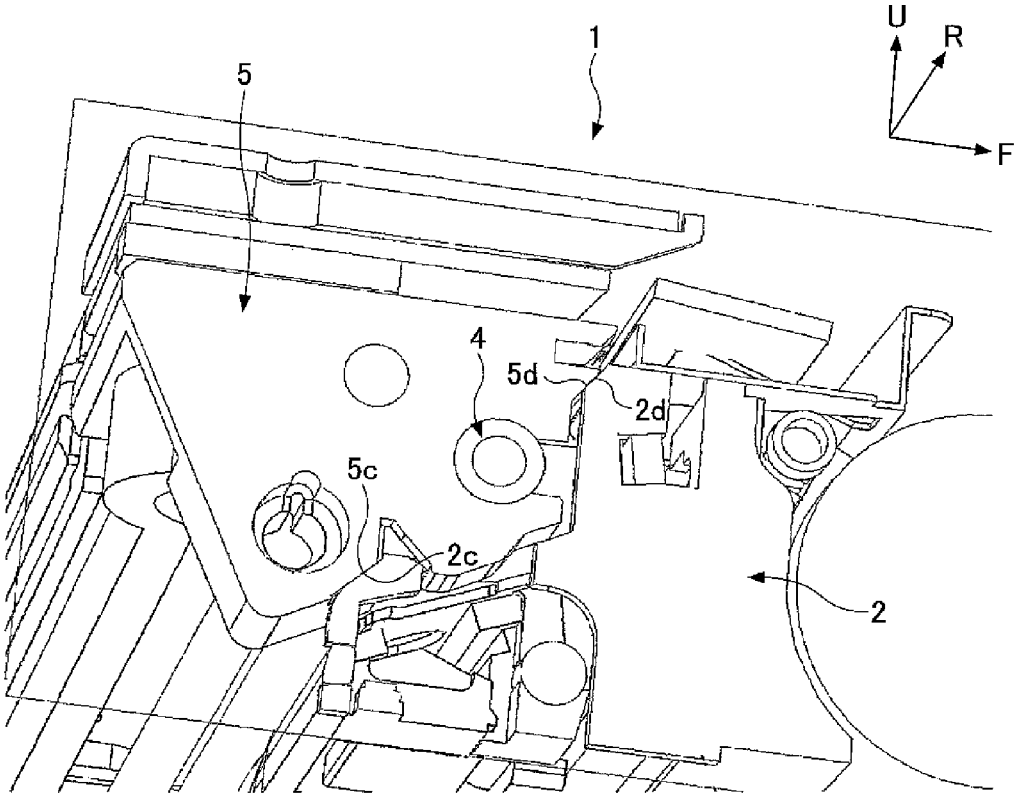
FIG. 11 is a schematic diagram showing a form of stoppers 5*c*+2*c* and 5*d*+2*d* for regulating rotation of the platen unit case 5 around the spindle 4*a* when the open case 3 is in the closed state in the printer 1 of an embodiment 2.

Therefore, the printer 1 of the present embodiment 2 is provided with stoppers 5*c*+2*c* and 5*d*+2*d* as shown in FIG. 11 as a regulation part for regulating (restricting) relative position relationship between the platen unit case 5 and the body-side case 2 in the closed state. These stoppers 5*c*+2*c* and 5*d*+2*d* are placed at two portions on a periphery in a circumferential direction of the spindle 4*a*, that is, the platen roller 4.

In the stoppers 5*c*+2*c* and 5*d*+2*d* placed on the periphery, the stopper 5*c*+2*c* regulates (restricts) rotation of the platen unit case 5 in the direction in which the press force of the spring 9 decreases. The stopper 5*c*+2*c* is placed in a side of a rotation center with respect to the platen roller 4, the rotation center being placed in a left side in FIG. 11, that is, in the back side of the front-back direction.

Similarly, in the stoppers 5*c*+2*c* and 5*d*+2*d*, the stopper 5*d*+2*d* placed in an opposite side of the rotation center with respect to the platen roller 4 regulates rotation of the platen unit case 5 in a direction in which the press force of the spring 9 increases.

The lower end part of the platen unit case 5 includes a contact surface 5*c* that forms the stopper 5*c*+2*c*, and a part of the body-side case 2 forms a contacted surface 2*c* which is contacted by the contact surface 5*c* that forms the stopper 5*c*+2*c*. Both of the contact surface 5*c* and the contacted surface 2*c* are formed on a same diameter of the platen roller 4, and are formed to be almost perpendicular to the circumference direction.

The back-side upper end part of the platen unit case 5 includes a contact surface 5*d* that forms the stopper 5*d*+2*d*, and a part of the body-side case 2 forms a contacted surface 2*d* which is contacted by the contact surface 5*c* that forms the stopper 5*d*+2*d* in the closed state. Both of the contact surface 5*d* and the contacted surface 2*d* are formed on a same diameter of the platen roller 4, and are formed to be almost perpendicular to the circumference direction.

In the printer 1 of the present embodiment 2, the rotation regulation function of the stoppers 5*c*+2*c* and 5*d*+2*d* stables the behavior of the platen unit case 5 with respect to the open case 3 around the platen roller 4 and the spindle 4*a*, so that it becomes possible to maintain the mode 1 shown in the FIG. 10A by prohibiting the mode 1 from changing to the mode 2 or the mode 3 shown in FIGS. 10B and 10B. Thus, normal cutting of the print medium can be ensured.

In the embodiments 1 and 2, by devising the movable blade 7, the cutting ability for cutting the print medium can be further enhanced. In the following, an embodiment 3 related to this enhancement is described.

Embodiment 3

In the following, a general configuration of a movable blade related to the technical concept of the embodiment 3 is described. In general, when the print medium is relatively thin, a blade surface that is a surface, of the movable blade, contacting the print medium is formed vertically with respect to the moving direction of the movable blade when performing cutting operation. When the print medium is relatively thick, a blade surface that is a surface of the movable blade contacting the print medium is formed such that the surface is inclined with respect to the moving direction and that an opposite surface that is opposite to the fixed blade becomes long in the moving direction with respect to a non-opposite surface of the reverse side of the opposite surface.

Especially, according to the movable blade of the latter case in which the blade surface is inclined with respect to the moving direction in the case when the print medium is thick, it is necessary to perform polishing or shaving while keeping the base material being inclined in the fabrication process of the moving blade. Thus, the fabrication process is complicated so that the cost increases.

Figure 12B:
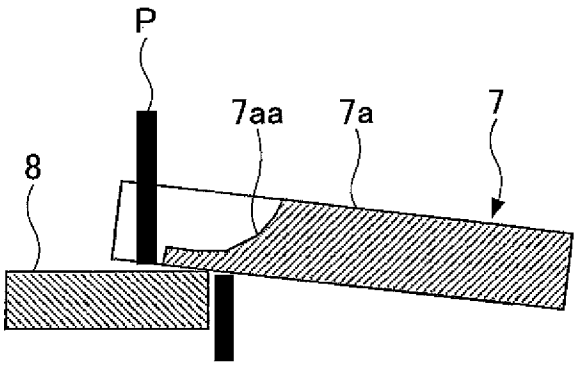
FIGS. 12A and 12B are schematic diagrams showing a movable blade 7 in the printer 1 of the embodiment 3 and a process method of it.
Figure 12A:
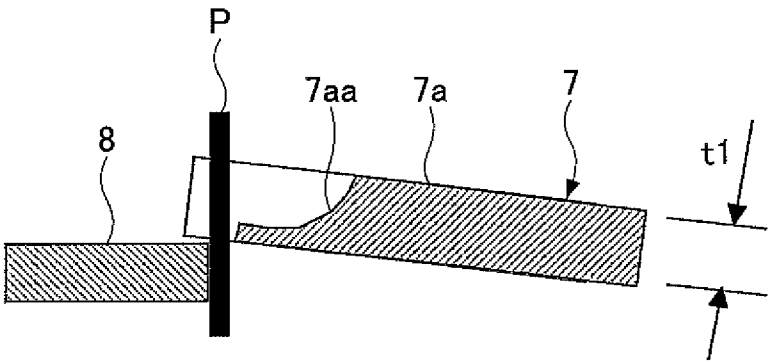

The movable blade 7 used for the printer 1 of the present embodiment 3 is formed as shown in FIGS. 12A and 123 in order to increase cutting ability for cutting the print medium P and to decrease the cost. In the movable blade shown in FIGS. 12A and 12B, the blade edge 7*aa* of the movable blade 7 is formed by performing R polishing, and also the blade edge 7*aa* is formed by performing R polishing on a non-opposite surface 7*a* of the reverse side of an opposite surface opposite to the fixed blade 8.

The movable blade 7 of the present embodiment 3 is formed in the following way.

Figure 13:
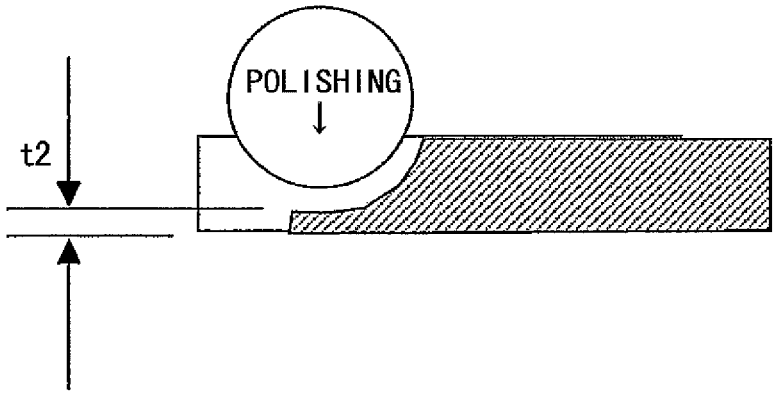
FIG. 13 is a schematic diagram showing a movable blade 7 in the printer 1 of the embodiment 3 and a process method of it.

A base material of a plate having a thickness t1 is placed on a plane pedestal such as a lathe, for example. In this state, as shown in FIG. 13, R processing is performed using a cylindrical grindstone by placing the grindstone such that a center axis line of the grindstone is in parallel with the edge part of the base material. In this case, the center part of the grindstone may be placed at the edge part, may be displaced to a side separating from the edge part, or may be displaced to a side toward the base material.

Accordingly, either one of two forms can be selected in which only the R processed part is provided on the blade edge 7*aa* in one form, and both of the R processed part and the straight part that is in parallel with the plane of the base material are provided in another form.

According to the movable blade 7 of the printer 1 of the embodiment 3, the thickness of the blade edge 7*aa* can be decreased by using the cylindrical grindstone. By using the generally-cheap cylindrical grindstone and by eliminating the work for holding the base material to be inclined, the cost of fabrication equipment can be reduced and the fabrication process can be simplified so that the whole cost can be decreased.

In addition, in the present embodiment 3, as shown in FIG. 13, it becomes easy to keep a proper thickness t2 of the blade edge 7*aa* for cutting the print medium while decreasing the thickness t2 and while keeping a predetermined ratio with respect to the thickness t1 of the base material. That is, the blade edge 7*aa* of the movable blade 7 can be prevented from having sharpness that is not essential for cutting the print medium P. Accordingly, working safety and quality of product can be further enhanced.

In the embodiment 3, the movable blade 7 on which R processing is applied is described. Other than that, the movable blade 7 can be formed based on lamination of plate materials. In the following, an embodiment 4 related to this is described.

Embodiment 4

Figure 14B:
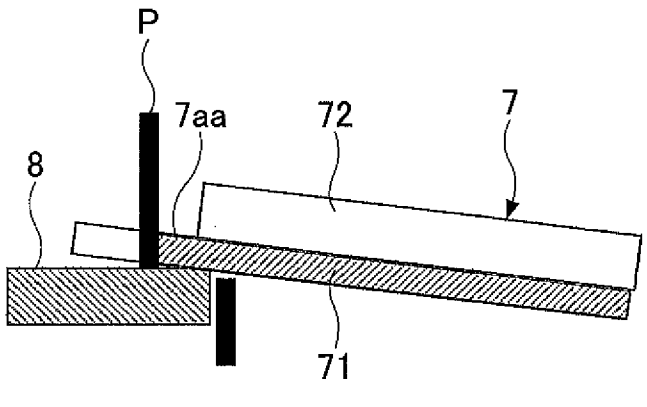
FIGS. 14A and 14B are schematic diagrams showing another example of the movable blade 7 in the printer 1 of the embodiment 4 and a fabrication method thereof.
Figure 14A:
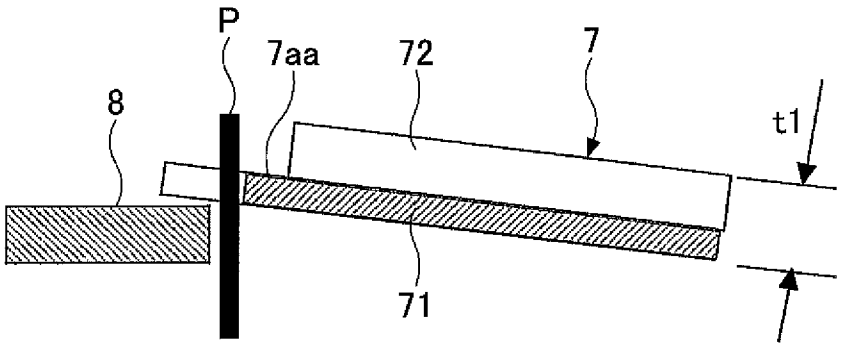

In the movable blade 7 used in the printer 1 of the present embodiment 4, the blade edge 7*aa* of the movable blade 7 is formed as a lamination of a blade plate 71 and a reinforcing plate 72 as shown in FIGS. 14A and 14B. The length of the reinforcing plate 72 is set to be shorter than that of the blade plate 71 in the moving direction. The thickness of the reinforcing plate 72 is set to be larger than that of the blade plate 71. Also, the blade plate 71 is projected toward the side of the blade edge 7*aa* with respect to the reinforcing plate 72.

Figure 15:
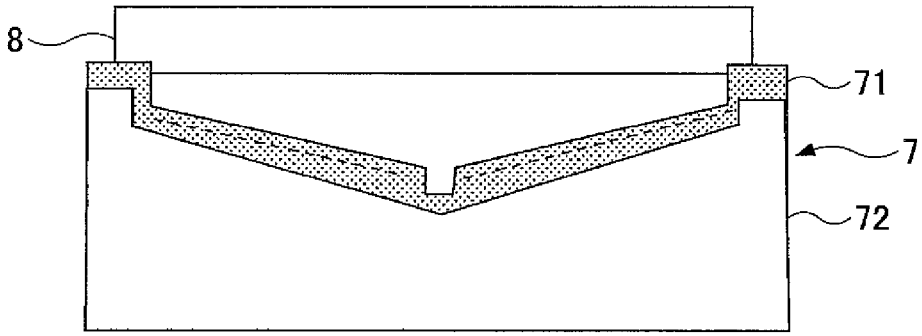
FIG. 15 is a schematic diagram showing another example of the movable blade 7 in the printer 1 of the embodiment 4 and a fabrication method thereof.
Figure 16:
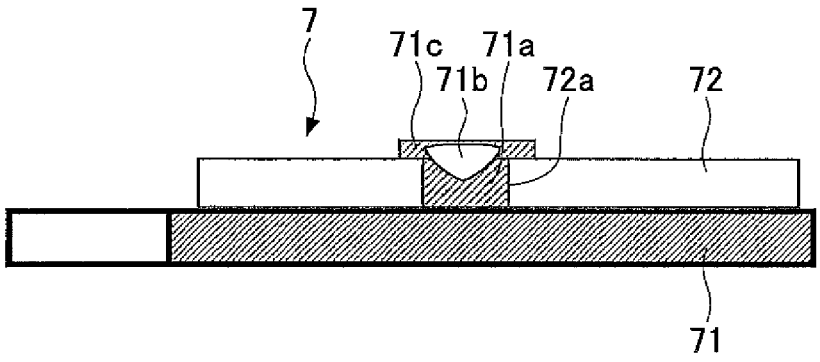
FIG. 16 is a schematic diagram showing another example of the movable blade 7 in the printer 1 of the embodiment 4 and a fabrication method thereof.

Various methods can be adopted for laminating the plates. In an example, a method shown in FIG. 16 can be adopted in the case when each of the movable blade 7 and the fixed blade 8 has a V shape in the horizontal direction as shown in FIG. 15, and lamination is performed by connecting the reinforcing plate 72 to the blade plate 71 at a pair of left-right connection portions. FIG. 16 shows a vertical section of the movable blade 7 including the connection portions with respect to the lateral direction. FIG. 16 shows a section of the movable blade 7, the section being vertical with respect to the horizontal direction and including a connection portion.

That is, as shown in FIG. 16, when fabricating the movable blade 7, a protrusion 71*a* that protrudes to the side of the reinforcing plate 72 is provided in the blade plate 71 by doweling or burring. In addition, an insertion hole 72*a* for inserting the protrusion 71*a* is provided in the reinforcing plate 72. After the protrusion 71*a* is inserted into the insertion hole 72*a*, an embedding part 71*b* is embedded by applying a pressure from the upside so that the periphery surface of the protrusion 71*a* is swaged in an inner periphery surface of the insertion hole 72*a* of the reinforcing plate 72, in which the embedding part 71*b* has an approximately cone-like shape having a triangle shape in a section and is provided on the top of the protrusion 71*a*. Also, a retaining part 71*c* having an outer diameter larger than that of the insertion hole 72*a* is integrally formed. Accordingly, the blade plate 71 is connected to the reinforcing plate 72.

According to the movable blade 7 used for the printer 1 of the present embodiment 4, thickness of the blade edge 7*aa* can be decreased by a lamination process and a connection process that are relatively simple as mentioned above. Thus, the fabrication process is simplified so that the cost can be reduced. Instead of the above-mentioned connection method, connection by using an adhesive or connection using welding may be used.

Also in the present embodiment, it becomes easy to keep a proper thickness of the blade edge for cutting the print medium while decreasing the thickness and while keeping a predetermined ratio with respect to the whole thickness of the base material. That is, the blade edge 7*aa* of the movable blade 7 can be prevented from having sharpness that is not essential for cutting the print medium P. Accordingly, working safety and quality of product can be further enhanced.

In addition, in the present embodiment 4, compared to the embodiment 3, special processing such as polishing is unnecessary. Generally, since SK material or SKH material for forming blade material 71 is expensive, the material unit price can be decreased by thinning the blade material 71. As to the reinforcing plate 72, a relatively cheap material can be used such as normal SUS material, zinc steel plate and the like. Accordingly, the cost of raw materials used for the movable blade 7 can be reduced so that the whole cost can be reduced.

The movable blade 7 shown in the embodiments 3 and 4 can be used for the printer 1 of the embodiment 1 in which the platen unit case 5 is slidable in the radial direction of the rotation center so that storing ability is ensured for storing the spindle 4*a* of the platen roller 4 into the storing part 2*a* when the state changes to the closed state. Also, the movable blade 7 shown in the embodiments 3 and 4 can be used for the printer 1 of the embodiment 2 in which rotation behavior of the platen unit case 5 around an axis of the horizontal direction is regulated in the closed state. Accordingly, the cutting ability for cutting the print medium can be enhanced dramatically.

However, it is not essential to use the movable blade 7 shown in the embodiments 3 and 4 in the printer of embodiment 1 for ensuring the ability of storing the spindle 4*a* of the platen roller 4 or in the printer 1 of the embodiment 2 for regulating rotation of the platen unit case 5. The movable blade 7 shown in the embodiments 3 and 4 can be used for a normal printer, so that the cutting ability for cutting the print medium can be enhanced, and work safety is improved and quality of product can be enhanced.

The present invention is not limited to these embodiments, and various variations and modifications may be made without departing from the scope of the present invention.

The embodiments are related to a printer. The printer can enhance customer satisfaction by realizing secure and smooth engagement between the movable part and the fixed part. Also, it is advantageous to apply the embodiments to a printer in which an extension direction from a rotation center of the movable part includes a vertical direction when the movable part is rotated with respect to the fixed part.

What is claimed is:

1. A printer comprising:

a fixed part;

a movable part that is connected to the fixed part rotatably around a rotation center such that one of an open state and a closed state is selectable;

a cylindrical body configured to transfer a print medium;

a holding part configured to hold the cylindrical body;

a regulation part; and a restraint part configured to restrain the holding part to the movable part such that the holding part can slide in a radial direction of the rotation center;

wherein the restraint part includes:

an engaging part that forms a part of one of the holding part and the movable part; and an engaged part that forms a part of another one of the holding part and the movable part and that is engaged to the engaging part, and the fixed part includes a storing part configured to store spindles placed in both ends of the cylindrical body when the movable part is in the closed state;

wherein the regulation part is configured to regulate rotation of the holding part around the spindle in the closed state.

2. The printer as claimed in claim 1, wherein the engaging part includes a projected piece that is provided in one of the holding part and the movable part, and the engaged part includes a folded part that is formed in another one of the holding part and the movable part.

3. The printer as claimed in claim 2, wherein the folded part includes a hole part to which the projected piece is inserted in the radial direction.

4. A printer comprising:

a fixed part;

a movable part that is connected to the fixed part rotatably around a rotation center such that one of an open state and a closed state is selectable;

a cylindrical body configured to transfer a print medium;

a holding part configured to hold the cylindrical body; and a restraint part configured to restrain the holding part to the movable part such that the holding part can slide in a radial direction of the rotation center;

wherein the restraint part includes:

an engaging part that forms a part of one of the holding part and the movable part, said engaging part including a projected piece, and an engaged part that forms a part of another one of the holding part and the movable part and that is engaged to the engaging part, said engaged part including a folded part that includes a hole into which the projected piece is inserted;

wherein the fixed part includes a storing part configured to store spindles placed in both ends of the cylindrical body when the movable part is in the closed state; and wherein the engaging part is engaged to the engaged part with an allowance between the projected piece and the folded part in a vertical direction;

wherein the projected piece is provided at an edge of the holding part or the movable part;

wherein the projected piece protrudes from the holding part in a first direction that is substantially perpendicular to the vertical direction;

wherein the engaged part extends along a second direction that is substantially perpendicular to said vertical direction and said first direction.

5. The printer as claimed in claim 4, further comprising:

a guiding part configured to guide the spindles into the storing part before the movable part is set to the closed state.

6. The printer as claimed in claim 4, wherein the guiding part is an inclined surface that is inclined with respect to a moving locus of the spindles when a state changed from the open state to the closed state.

7. The printer as claimed in claim 4, further comprising:

a control part configured to control an amount of sliding of the holding part in the radial direction with respect to the movable part, wherein the control part includes:

a projected part that protrudes from one of the holding part and the movable part to the other of the holding part and the movable part; and a hole part that is included in the other of the holding part and the movable part, and that corresponds to the projected part;

wherein the projected part includes a top part having an external size larger than a size of the hole part in a protruded side with respect to a part inserted in the hole part; and wherein the projected part is inserted into the hole part.

8. The printer as claimed in claim 7, wherein a length between a base part of the projected part and the top part is larger than a depth of the hole part.

9. A printer comprising:

a fixed part;

a movable part that is connected to the fixed part rotatably around a rotation center such that one of an open state and a closed state is selectable;

a cylindrical body configured to transfer a print medium;

a holding part configured to hold the cylindrical body; and a restraint part configured to restrain the holding part to the movable part such that the holding part can slide in a radial direction of the rotation center;

wherein the restraint part includes:

an engaging part that forms a part of one of the holding part and the movable part, said engaging part including a projected piece, and an engaged part that forms a part of another one of the holding part and the movable part and that is engaged to the engaging part, said engaged part including a folded part that includes a hole into which the projected piece is inserted;

wherein the fixed part includes a storing part configured to store spindles placed in both ends of the cylindrical body when the movable part is in the closed state;

wherein the engaging part is engaged to the engaged part with a vertical allowance between the projected piece and the folded part; and wherein the printer further comprises a regulation part configured to regulate rotation of the holding part around the spindle in the closed state.

10. The printer as claimed in claim 9, wherein the regulation part includes a contacting surface of the holding part and a contacted surface which the contacting part contacts.

11. The printer as claimed in claim 10, further comprising:

a movable blade and a fixed blade configured to cut the print medium; and a pressing part configured to press one of the movable blade and the fixed blade to another one of them in a thickness direction, wherein the regulation part includes a first part and a second part that are placed on two portions on a periphery in a circumference direction of the spindle, and one of the first part and the second part regulates rotation of the holding part in a direction in which a press force of the pressing part decreases, wherein the one of the first part and the second part is placed on a side of the rotation center, between the spindle and the rotation center.

12. The printer as claimed in claim 11, wherein the other one of the first part and the second part regulates rotation of the holding part in a direction in which a press force of the pressing part increases, wherein the other one of the first part and the second part is placed on the side of the rotation center, with the spindle between the one of the first part and the second part and the other of the first part and the second part.

13. The printer as claimed in claim 11, wherein a blade edge of the movable blade is formed by performing R polishing.

14. The printer as claimed in claim 13, wherein the R polishing is performed on a surface of the movable blade that is opposite to a surface of the movable blade facing the fixed blade.

15. The printer as claimed in claim 11, wherein the blade edge of the movable blade is formed by a lamination of a blade plate and a reinforcing plate.

16. The printer as claimed in claim 15, wherein the reinforcing plate is shorter than the blade plate in a movable direction of the movable blade, and is thicker than the blade plate in a thickness direction.

17. The printer as claimed in claim 16, wherein the blade plate includes a protrusion that protrudes toward the reinforcing plate, and the blade plate is connected to the reinforcing plate by embedding an embedding part into a top part of the protrusion.

* * * * *